US011421178B2

(12) United States Patent
Sato

(10) Patent No.: US 11,421,178 B2
(45) Date of Patent: Aug. 23, 2022

(54) LUBRICATING OIL COMPOSITION FOR AIR COMPRESSORS, AIR COMPRESSOR LUBRICATING METHOD, AND AIR COMPRESSOR

(71) Applicant: IDEMITSU KOSAN CO., LTD., Chiyoda-ku (JP)

(72) Inventor: Tokue Sato, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/284,847

(22) PCT Filed: Sep. 26, 2019

(86) PCT No.: PCT/JP2019/037862
§ 371 (c)(1),
(2) Date: Apr. 13, 2021

(87) PCT Pub. No.: WO2020/080057
PCT Pub. Date: Apr. 23, 2020

(65) Prior Publication Data

US 2021/0388287 A1 Dec. 16, 2021

(30) Foreign Application Priority Data

Oct. 17, 2018 (JP) ..... JP2018-196014

(51) Int. Cl.

| | |
|---|---|
| ***C10M 169/04*** | (2006.01) |
| ***C10M 105/42*** | (2006.01) |
| ***C10M 107/34*** | (2006.01) |
| ***C10M 133/12*** | (2006.01) |
| ***C10M 135/10*** | (2006.01) |
| *C10N 10/04* | (2006.01) |
| *C10N 30/10* | (2006.01) |
| *C10N 30/12* | (2006.01) |
| *C10N 40/30* | (2006.01) |

(52) U.S. Cl.
CPC ..... *C10M 169/04* (2013.01); *C10M 105/42* (2013.01); *C10M 107/34* (2013.01); *C10M 133/12* (2013.01); *C10M 135/10* (2013.01); *C10M 2209/1055* (2013.01); *C10M 2215/065* (2013.01); *C10M 2219/044* (2013.01); *C10N 2010/04* (2013.01); *C10N 2030/10* (2013.01); *C10N 2030/12* (2013.01); *C10N 2040/30* (2013.01)

(58) Field of Classification Search
CPC ..... C10M 169/04; C10M 105/38; C10M 107/34; C10M 129/72; C10M 133/16; C10M 133/38; C10M 133/46; C10M 135/10; C10N 2040/30; C10N 2010/04
See application file for complete search history.

(56) References Cited

U.S. PATENT DOCUMENTS

| | | | |
|---|---|---|---|
| 4,302,343 | A | 11/1981 | Carswell et al. |
| 6,127,324 | A | 10/2000 | Tolfa et al. |
| 2004/0075079 | A1 | 4/2004 | Bunemann et al. |
| 2005/0250654 | A1 | 11/2005 | Randles et al. |
| 2017/0073611 | A1* | 3/2017 | Greaves ..... C10M 169/044 |
| 2019/0106648 | A1 | 4/2019 | Kusumoto et al. |
| 2019/0177648 | A1 | 6/2019 | Aoki et al. |

FOREIGN PATENT DOCUMENTS

| | | | |
|---|---|---|---|
| CN | 102264877 | A | 11/2011 |
| CN | 106471105 | A | 3/2017 |
| EP | 0 017 072 | A2 | 10/1980 |
| EP | 2 274 408 | A1 | 1/2011 |
| EP | 3 119 861 | A1 | 1/2017 |
| JP | 55-133489 | A | 10/1980 |
| JP | 2004-524414 | A | 8/2004 |
| JP | 2016-193994 | A | 11/2016 |
| JP | 2017-509749 | A | 4/2017 |
| JP | 2018-28024 | A | 2/2018 |
| WO | 02/077135 | A1 | 10/2002 |
| WO | WO 2013/146805 | A1 | 10/2013 |
| WO | 2016/159041 | A1 | 10/2016 |
| WO | WO 2017/170948 | A1 | 10/2017 |
| WO | WO 2018/034189 | A1 | 2/2018 |

OTHER PUBLICATIONS

King Industries Specialty Chemicals, Product Data Sheet: NA-SUL BSB (Year: 2004).*
International Search Report dated Nov. 12, 2019 in PCT/JP2019/037862 filed Sep. 26, 2019, 3 pages.
Office Action dated May 10, 2022, in Japanese Patent Application No. 2018-196014 (with computer generated English translation).
Office Action dated May 18, 2022, in Chinese Appication No. 201980067681.4.
Liu Jia et al., "Review on Copolyether of Ethylene Oxide and Propylene Oxide", China (Oct. 2008) (with English abstract).
Supplementary European Search Report dated Jun. 15, 2022, in European Patent Application No. 19873467.5.

* cited by examiner

*Primary Examiner* — Vishal V Vasisth
(74) *Attorney, Agent, or Firm* — Oblon, McClelland, Maier & Neustadt, L.L.P.

(57) ABSTRACT

Provided is a lubricating oil composition for air compressors containing a polyalkylene glycol-containing base oil (A) and a rust-preventive agent (B), wherein the content of the polyalkylene glycol is 65.0% by mass or more based on the total amount of the composition. The lubricating oil composition is excellent in oxidation stability and also in rust prevention and storage stability. Also provided are an air compressor lubricating method and an air compressor using the lubricating oil composition.

19 Claims, No Drawings

LUBRICATING OIL COMPOSITION FOR AIR COMPRESSORS, AIR COMPRESSOR LUBRICATING METHOD, AND AIR COMPRESSOR

This application is a 371 of PCT/JP2019/037862 filed Sep. 26, 2019.

TECHNICAL FIELD

The present invention relates to a lubricating oil composition for air compressors, an air compressor lubricating method, and an air compressor.

BACKGROUND ART

A lubricating oil composition for air compressors is used in severe environments for long-term use in high-temperature environments often generating deposits such as sludge accompanied by oxidative deterioration.

Deposits such as sludge adhere to, for example, a bearing of a rotor to generate heat, thereby providing a risk of bearing damage, or may clog a filter arranged in a circulation line, or may deposit on a control valve, thereby often causing control system operation failures, etc. Therefore, a lubricating oil composition for air compressors is required to prevent oxidation. Consequently, for a lubricating oil composition for use for air compressors, various investigations have been made essentially relating to the lubricant base oil and additives such as an antioxidant.

For example, PTL 1 discloses a lubricating oil composition for air compressors, the composition including a synthetic base oil which is a mixed oil of a polyglycol-based synthetic oil and an ester-based synthetic oil, and one or more amine-based antioxidants selected from a specific compound group such as asymmetric diphenylamine-based compounds. According to PTL 1, there is shown a result of preventing sludge precipitation while appropriately preventing oxidation.

CITATION LIST

Patent Literature

SUMMARY OF INVENTION

Technical Problem

In an air compressor, moisture such as water or water vapor may penetrate into the instrument system to often cause rust generation on the surfaces of the instrument system formed of iron and the like, and therefore an air compressor is an equipment that may often cause a problem of bearing damage by rust generation and the above-mentioned other problems. Against rust generation, use of a material that hardly undergoes rust generation as constituent members of an air compressor is being investigated, which, however, may result in cost increase, and therefore, a method of preventing rust generation has become investigated for a lubricating oil composition for use for air compressors.

The polyglycol-based synthetic oil used as a lubricant base oil in the lubricating oil composition for air compressors described in PTL 1 has such a property that it hardly undergoes oxidative deterioration and, even if oxidatively deteriorated, it hardly gives deposits such as sludge, that is, the polyglycol-based synthetic oil is a base oil having an advantage in point of good oxidation stability and storage stability but, on the other hand, the ol has such a property that the solubility thereof in water is high to promote rust generation inside instrument systems, that is, the oil is disadvantageous in point of rust prevention as a base oil. Consequently, the lubricating oil composition for air compressors described in PTL 1 could not be said to satisfy both rust prevention and storage stability along with oxidation stability, and a lubricating oil composition for air compressors that satisfies all these properties is desired.

The present invention has been made in consideration of the above-mentioned situation, and its object is to provide a lubricating oil composition for air compressors excellent in rust prevention and storage stability along with oxidation stability, and to provide an air compressor lubricating method and an air compressor using the composition.

Solution to Problem

As a result of assiduous studies made for the purpose of solving the problems, the present inventors have found that the present invention described below can solve the problems. Specifically, the present invention is to provide a lubricating oil composition for air compressors having the constitution described below, and to provide an air compressor lubricating method and an air compressor using the composition.

1. A lubricating oil composition for air compressors, containing a polyalkylene glycol containing base oil (A) and a rust-preventive agent (B), wherein the content of the polyalkylene glycol is 65.0% by mass or more based on the total amount of the composition.
2. An air compressor lubricating method, using the lubricating oil composition for air compressors of the above 1.
3. An air compressor using the lubricating oil composition for air compressors of the above 1.

Advantageous Effects of Invention

According to the present invention, there can be provided a lubricating oil composition for air compressors excellent in rust prevention and storage stability along with oxidation stability, and an air compressor lubricating method and an air compressor using the composition.

DESCRIPTION OF EMBODIMENTS

Embodiments of the present invention relating to a lubricating oil composition for air compressors and to an air compressor lubricating method and an air compressor using the composition (hereinunder this may be referred to as "the present embodiment") are described specifically hereinunder. In this description, numerical values expressed in terms of "or more", "or less", and "XX to XXX" can be combined in any desired manner, and the numerical values in Examples can be set as an upper limit or a lower limit.

[Lubricating Oil Composition for Air Compressors]

The lubricating oil composition for air compressors of the present embodiment contains a polyalkylene glycol-containing base oil (A) and a rust-preventive agent (B), wherein the content of the polyalkylene glycol is 65.0% by mass or more based on the total amount of the composition.

(Polyalkylene Glycol-Containing Base Oil (A))

The lubricating oil composition for air compressors of the present embodiment contains a polyalkylene glycol containing base oil (A) (hereinunder this may be referred to as "base oil (A)"). Polyalkylene glycol is a base oil having such a property that it is hardly oxidatively degraded, and hardly forms deposits such as sludge even when oxidatively degraded, that is, it is a base oil excellent in oxidation stability and storage stability, and therefore, using the base oil (A) containing this, the lubricating oil composition can achieve excellent oxidation stability and storage stability.

Examples of the polyalkylene glycol include a polymer produced by polymerization or copolymerization of an alkylene oxide, and from the viewpoint of improving oxidation stability and storage stability, preferably, at least one or more terminals of the polyalkylene glycol are blocked with a substituent. One alone plural kinds of such polyalkylene glycols can be used either singly or as combined.

More specifically, the polyalkylene glycol blocked with a substituent at least at one or more terminals thereof is preferably a compound represented by, for example, the following general formula (1).

$$R^{11}-[(OR^{12})_{n_{11}}-OR^{13}]_{n_{12}} \quad (1)$$

In the general formula (1), $R^{11}$ represents a hydrogen atom, a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms, $R^{12}$ represents an alkylene group having 2 to 4 carbon atoms, $R^{13}$ represents a hydrogen atom, a monovalent hydrocarbon group having 1 to 10 carbon atoms, an acyl group having 2 to 10 carbon atoms, or a heterocyclic group having 3 to 10 ring atoms, plural $R^{12}$'s and $R^{13}$'s, if any, may be the same or different. $n_{11}$ represents a number of 1 or more, and $n_{12}$ represents a number of 1 to 6.

At least one of $R^{11}$ and $R^{13}$ in the general formula (1) is, from the viewpoint of improving oxidation stability and storage stability, preferably a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms. Namely, at least one of them is preferably not a hydrogen atom, and is more preferably a monovalent hydrocarbon group having 1 to 10 carbon atoms. Also from the viewpoint of improving oxidation stability and storage stability, in particular, both $R^{11}$ and $R^{13}$ are preferably a monovalent hydrocarbon group having 1 to 10 carbon atoms. Here, $R^{11}$ and $R^{13}$ include linear and branched groups.

Examples of the monovalent hydrocarbon group having 1 to 10 carbon atoms for $R^{11}$ and $R^{13}$ include an alkyl group such as a methyl group, an ethyl group, a propyl group (for example, an n-propyl group and an isopropyl group), a butyl group (for example, including not only a linear n-butyl group but also branched groups such as an isobutyl group, a s-butyl group and a t-butyl group, and the same shall apply to the groups to be exemplified hereinunder), a pentyl group, a hexyl group, a heptyl group, an octyl group, a nonyl group, and a decyl group; a cycloalkyl group such as a cyclopentyl group, a cyclohexyl group, a methylcyclohexyl group, an ethylcyclohexyl group, a propylcyclohexyl group, and a dimethylcyclohexyl group; an aryl group such as a phenyl group, a methylphenyl group, an ethylphenyl group, a dimethylphenyl group, a propylphenyl group, a trim ethylphenyl group, a butylphenyl group, and a naphthyl group; and an arylalkyl group such as a benzyl group, a phenylethyl group, a methylbenzyl group, a phenylpropyl group, and a phenylbutyl group. Examples thereof also include an alkenyl group, a cycloalkenyl group and an arylalkenyl group that are configured by removing two hydrogen atoms from the above-mentioned alkyl group, cycloalkyl group and arylalkyl group, respectively.

The carbon number of the monovalent hydrocarbon group is, from the viewpoint of improving oxidation stability and storage stability, preferably 1 or more, and the upper limit thereof is preferably 10 or less, more preferably 6 or less, even more preferably 4 or less.

Regarding the acyl group having 2 to 10 carbon atoms for $R^{11}$ and $R^{13}$, the hydrocarbon group moiety that the acyl group has includes those having 1 to 9 carbon atoms of the monovalent hydrocarbon group exemplified for $R^{11}$ and $R^{13}$ hereinabove, and may be linear, branched or cyclic.

The carbon number of the acyl group is, from the viewpoint of improving oxidation stability and storage stability, preferably 2 or more, and the upper limit thereof is preferably 10 or less, more preferably 6 or less.

The divalent to hexavalent hydrocarbon group for $R^{11}$ includes a residue configured by further removing 1 to 5 hydrogen atoms from the monovalent hydrocarbon of $R^{11}$, and a residue configured by removing hydroxy groups from a polyalcohol such as trimethylolpropane, glycerin, pentaerythritol, sorbitol, 1,2,3-trihydroxycyclohexane, and 1,3,5-trihydroxycyclohexane.

The carbon number of the divalent to hexavalent hydrocarbon group is, from the viewpoint of improving oxidation stability and storage stability, preferably 1 or more, and the upper limit thereof is preferably 10 or less, more preferably 6 or less, even more preferably 4 or less.

The heterocyclic group having 3 to 10 ring atoms for $R^{11}$ and $R^{13}$ includes an oxygen atom-containing heterocyclic group and a sulfur atom-containing heterocyclic group. The heterocyclic group may be a saturated ring or an unsaturated ring.

Examples of the oxygen atom-containing heterocyclic group include a residue configured by removing 1 to 6 hydrogen atoms from an oxygen atom-containing saturated hetero ring such as 1,3-propylene oxide, tetrahydrofuran, tetrahydropyran and hexamethylene oxide, or from an oxygen-containing unsaturated hetero ring such as acetylene oxide, furan, pyran, oxycycloheptatriene, isobenzofuran and isochromene.

Examples of the sulfur atom-containing heterocyclic group include a residue configured by removing 1 to 6 hydrogen atoms from a sulfur atom-containing saturated hetero ring such as ethylene sulfide, trimethylene sulfide, tetrahydrothiophene, tetrahydrothiopyran and hexamethylene sulfide, or from a sulfur atom-containing unsaturated hetero ring such as acetylene sulfide, thiophene, thiapyran and thiotripyridene.

The ring atom number of the heterocyclic group is, from the viewpoint of improving oxidation stability and storage stability, preferably 3 or more, more preferably 5 or more, and the upper limit thereof is preferably 10 or less, more preferably 6 or less.

Examples of the alkylene group having 2 to 4 carbon atoms for $R^{12}$ include a linear or branched alkylene group, such as an alkylene group having 2 carbon atoms such as an ethylene group ($—CH_2CH_2—$); an alkylene group having 3 carbon atoms such as a trimethylene group ($—CH_2CH_2CH_2—$), and a 1-methylethylene group (propylene group) ($—CH(CH_3)CH_2—$); and an alkylene group having 4 carbon atoms such as a tetramethylene group ($—CH_2CH_2CH_2CH_2—$), a 1-methyltrimethylene group ($—CH(CH_3)CH_2CH_2—$), a 2-methyltrimethylene group (—$CH_2CH(CH_3)CH_2$—), a butylene group (—$C(CH_3)_2CH_2$—), a 1-ethylethylene group (—$CH(CH_2CH_3)CH_2$—), and a 1,2-dimethylethylene group (—$CH(CH_3)$—$CH(CH_3)$—). In the case where the formula has plural $R^{12}$'s, the plural $R^{12}$'s may be the same as or different from each other.

Among these, from the viewpoint of improving oxidation stability and storage stability, $R^{12}$ is preferably an ethylene group (—$CH_2CH_2$—), or a 1-methylethylene group (propylene group) (—$CH(CH_3)CH_2$—).

$n_{12}$ is an integer of 1 to 6, and is defined according to the number of the bonding sites to $R^{11}$ in the general formula (1). For example, when $R^{11}$ is a monovalent hydrocarbon group such as an alkyl group or a cycloalkyl group, or an acyl group, $n_{12}$ is 1. Namely, in the case where $R^{11}$ is a hydrocarbon group or a heterocyclic group and the valence of the group is 1, 2, 3, 4, 5 or 6, $n_{12}$ is 1, 2, 3, 4, 5 or 6, respectively.

$n_{12}$ is, from the viewpoint of improving oxidation stability and storage stability, preferably 1 or more, and the upper limit thereof is preferably 4 or less, more preferably 3 or less, even more preferably 1.

$n_{11}$ is a number of 1 or more, and is a value to be appropriately set depending on the value of number-average molecular weight of the compound represented by the general formula (1). In the case where different two kinds of compounds represented by the general formula (1) are used, the value of $n_{11}$ is an average value (weighted average value), and the average value can be 1 or more.

The number-average molecular weight (Mn) of the polyalkylene glycol is, from the viewpoint of improving oxidation stability and storage stability, and also from the viewpoint of improving the viscosity index of the lubricating oil composition, preferably 200 or more, more preferably 240 or more, even more preferably 280 or more, further more preferably 320 or more, and the upper limit thereof is preferably 10,000 or less, more preferably 5,000 or less, even more preferably 3,000 or less, further more preferably 1,500 or less.

In this description, the number average molecular weight (Mn) is a value as expressed in terms of standard polystyrene, measured by gel permeation chromatography (GPC), and measurement conditions include conditions described in Examples.

The content of the polyalkylene glycol needs to be 65.0% by mass or more based on the total amount of the composition. When the content is less than 65.0% by mass, excellent oxidation stability and storage stability could not be achieved. The content of the polyalkylene glycol is, from the viewpoint of improving oxidation stability and storage stability, preferably 67.0% by mass or more based on the total amount of the composition, more preferably 69.0% by mass or more, even more preferably 70.0% by mass or more, further more preferably 71.0% by mass or more, and, in consideration of achieving more excellent rust prevention, the upper limit of the content is preferably 99.95% by mass or less, more preferably 97.5% by mass or less, even more preferably 90.0% by mass or less, further more preferably 85.0% by mass or less.

(Polyol Ester)

In the present embodiment, the base oil (A) may contain any other base oil than the above-mentioned polyalkylene glycol. The base oil that can be combined with the polyalkylene glycol is preferably a polyol ester. Combined use of the polyalkylene glycol and a polyol ester as the base oil improves rust prevention and storage stability along with oxidation stability.

For example, the polyol ester for use herein is preferably an ester of a diol or a polyol having approximately 3 to 20 hydroxy groups, and a fatty acid having approximately 1 to 24 carbon atoms.

Examples of the diol include ethylene glycol, various propane diols, various butane diols, various pentane diols, various hexane diols, various heptane diols, various octane diols, various nonane diols, various decane diols, various undecane diols, and various dodecane diols.

Examples of the polyol having approximately 3 to 20 hydroxy groups include polyalcohols such as trimethylolethane, trimethylolpropane, trimethylolbutane, trimethylolpentane, trimethylolhexane, trimethylolheptane, di-(trimethylolpropane), tri-(trimethylolpropane), pentaerythritol, di(pentaerythritol), tri-(pentaerythritol), glycerin, polyglycerin (2 to 20mer of glycerin), 1,3,5-pentanetriol, sorbitol, sorbitan, sorbitol glycerin condensate, adonitol, arabitol, xylitol, and mannitol; saccharides such as xylose, arabinose, ribose, rhamnose, glucose, fructose, galactose, mannose, sorbose, cellobiose, maltose, isomaltose, trehalose, sucrose, raffinose, gentianose, and melenzitose; as well as partial ethers and methylglucosides (glycosides) thereof.

Among the above-mentioned diols or polyols having approximately 3 to 20 hydroxy groups, especially from the viewpoint of improving rust prevention and storage stability along with oxidation stability by combination with the above-mentioned polyalkylene glycol, trimethylolpropane, neopentyl glycol, pentaerythritol and dehydrated condensates of two or three molecules thereof are preferred, trimethylolpropane, neopentyl glycol and pentaerythritol are more preferred, and trimethylolpropane is even more preferred.

The fatty acid to be used for forming the polyol ester is not specifically limited in point of the carbon number thereof, but generally those having 1 to 24 carbon atoms are used. Among the fatty acids having 1 to 24 carbon atoms, from the viewpoint of improving oxidation stability, rust prevention, storage stability and lubricity, those having 3 or more carbon atoms are preferred, those having 4 or more carbon atoms are more preferred, those having 5 or more carbon atoms are even more preferred, and those having 10 or more carbon atoms are further more preferred. Also in consideration of the miscibility with the rust-preventive agent (B), those having 18 or less carbon atoms are preferred, and those having 12 or less carbon atoms are more preferred.

The fatty acid may be any of a linear fatty acid or a branched fatty acid, and may be a saturated fatty acid or an unsaturated fatty acid, but in consideration of oxidation stability and storage stability, a saturated fatty acid is preferred.

Specifically, the fatty acid includes fatty acids such as pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, and oleic acid; and so-called neoacids having a quaternary a carbon atom. More specifically, preferred examples of the fatty acid include valeric acid (n-pentanoic acid), caproic acid (n-hexanoic acid), enanthic acid (n-heptanoic acid), caprylic acid (n-octanoic acid), pelargonic acid (n-nonanoic acid), capric acid (n-decanoic acid), oleic acid (cis-9-octadecenoic acid), isopentanoic acid (3-methylbutanoic acid), 2-methylhexanoic acid, 2-ethylpentanoic acid, 2-ethylhexanoic acid, and 3,5,5'trimethylhexanoic acid.

The polyol ester may be a partial ester in which all the hydroxy groups of a polyol are not esterified but some have remained as such, or a complete ester where all the hydroxy groups have been esterified, or may also be a mixture of a partial ester and a complete ester. From the viewpoint of improving oxidation stability and storage stability, a complete ester is preferred.

Among the above-mentioned polyol esters, from the viewpoint of improving oxidation stability and storage stability, preferred is a hindered ester of an ester of a hindered polyol having one or more quaternary carbons in the molecule and having 1 to 4 methylol groups bonding to at least one quaternary carbon therein, and an aliphatic monocarboxylic acid. Among such hindered esters, preferred are hindered esters corresponding to esters of trimethylolpropane, neopentyl glycol, pentaerythritol and dehydrated condensates of two molecules or three molecules thereof that are exemplified hereinabove as preferred diols or polyols; more preferred are those of trimethylolpropane, neopentyl glycol and pentaerythritol; and even more preferred are those of trimethylolpropane.

The aliphatic monocarboxylic acid for use for forming hindered esters includes a saturated aliphatic monocarboxylic acid having 5 to 22 carbon atoms. The aliphatic monocarboxylic acid includes those having one carboxyl group among fatty acids exemplified hereinabove as those for use for forming the above-mentioned polyol esters, and the saturated aliphatic monocarboxylic acid includes those not containing an unsaturated group and having one carboxy group, among the above-mentioned fatty acids. The acyl group in the aliphatic monocarboxylic acid may be linear or branched.

The carbon number of the aliphatic monocarboxylic acid is preferably 5 to 18, more preferably 6 to 14, even more preferably 8 to 10.

In esterification, one alone or plural kinds of these aliphatic monocarboxylic acids can be used either singly or as combined.

The number-average molecular weight (Mn) of the polyol ester is preferably 100 or more, more preferably 200 or more, even more preferably 300 or more, further more preferably 400 or more, and the upper limit thereof is preferably 8,000 or less, more preferably 4,000 or less, even more preferably 2,000 or less, further more preferably 1,000 or less.

The content of the polyol ester is, from the viewpoint of improving rust prevention and storage stability along with oxidation stability, preferably 3.0% by mass or more based on the total amount of the composition, more preferably 5.0% by mass or more, even more preferably 10.0% by mass or more, further more preferably 15.0% by mass or more, and the upper limit thereof is preferably 35.0% by mass or less, more preferably 30.0% by mass or less, even more preferably 25.0% by mass or less.

The ratio by mass of the content of the polyalkylene glycol to that of the polyol ester is, from the viewpoint of improving rust prevention and storage stability along with oxidation stability, preferably 55/45 to 95/5, more preferably 65/35 to 90/10, even more preferably 70/30 to 85/15, further more preferably 75/25 to 80/20.

(Mineral Oil)

In the present embodiment, the base oil that can be combined with the polyalkylene glycol for use herein also includes a mineral oil. Examples of the mineral oil include topped crudes obtained through atmospheric distillation of crude oils such as paraffin-based mineral oils, intermediate-based mineral oils and naphthene-based mineral oils; distillates obtained through reduced-pressure distillation of such topped crudes; mineral oils obtained by purifying the distillates through one or more purification treatments of solvent deasphalting, solvent extraction, hydrocracking, solvent dewaxing, catalytic dewaxing, or hydrorefining; and mineral oil (GTL) obtained by isomerizing a wax produced from a natural gas through Fischer-Tropsch synthesis (GTL wax (Gas To Liquids WAX)). Mineral oil grouped in Group 2 or 3 in the base oil category of API (American Petroleum Institute) is preferred. One alone or two or more kinds of these mineral oils may be used either singly or as combined.

The content of the mineral oil is not specifically limited, but from the viewpoint of improving rust prevention and storage stability along with oxidation stability, the content is preferably smaller, and in general, it is 5.0% by mass or less based on the total amount of the composition, preferably 3.0% by mass or less, more preferably 1.0% by mass or less, even more preferably 0.1% by mass or less, further more preferably 0% by mass, that is, preferably, the base oil does not contain a mineral oil.

(Other Base Oil)

In the present embodiment, the other base oil that can be combined with the polyalkylene glycol for use herein includes a poly-α-olefin. Various kinds of poly-α-olefins can be used, and for example, in general, a polymer of an α-olefin having 8 to 18 carbon atoms is usable. Above all, a polymer of 1-dodecene, 1-decene or 1-octene is preferred from the viewpoint of oxidation stability and lubricity, and a trimer or a tetramer of 1-decene is more preferred. One alone or two or more kinds of these poly-α-olefins can be used either singly or as combined.

The other base oil also includes an alkylated aromatic compound such as an alkylbenzene, an alkylnaphthalene, an alkylanthracene, an alkylphenanthrene, and an alkylbiphenyl. The carbon number of the alkyl group in these alkylated aromatic compounds is preferably 1 to 40, more preferably 4 to 35. One alone or two or more kinds of these alkylated aromatic compounds can be used either singly or as combined.

The content of the poly-α-olefin and the alkylated aromatic compound is not specifically limited, but is, for example, 0.5% by mass or more and 10.0% by mass or less or so, based on the total amount of the composition.

(Rust-Preventive Agent (B))

The lubricating oil composition for air compressors of the present embodiment contains a rust-preventive agent (B). The lubricating oil composition for air compressors contains, as a base oil, a polyalkylene glycol having a high solubility in water and having a property to promote rust generation, and therefore, if not containing a rust-preventive agent (B), the lubricating oil could not achieve rust prevention.

As the rust-preventive agent (B), a rust-preventive agent that is used as an agent to express rust prevention in a lubricating oil composition can be used, and can be selected without any limitation, for example, from metal sulfonates, carboxylic amides, imidazole compounds, succinates, benzotriazole compounds, organic phosphites, organic phosphates, organic metal phosphates, and polyalcohol esters. In consideration that the agent is used along with the base oil (A) that contains a polyalkylene glycol having a property of promoting rust generation as a base oil, metal sulfonates, carboxylic amides, imidazole compounds, succinates, and benzotriazole compounds capable of expressing more excellent rust prevention in relation with the base oil (A) are preferred, metal sulfonates, imidazole compounds, succinates and benzotriazole compounds are more preferred, and metal sulfonates, imidazole compounds and succinates are even more preferred. Also in relation with the base oil (A)

and depending on the kind of the rust-preventive agent, when the amount of the rust-preventive agent to be added is increased for achieving more excellent rust prevention, precipitates such as sludge may readily form and storage stability may thereby worsen. As opposed to this, using those rust-preventive agents mentioned above, they can express excellent rust prevention even when the amount thereof used is smaller, therefore providing more excellent storage stability along with rust prevention. One alone or two or more of these rust-preventive agent can be used either singly or as combined.

(Metal Sulfonate)

Metal sulfonates are metal salts of various sulfonic acids.

Various sulfonic acids to constitute metal sulfonates include aromatic petroleum sulfonic acids, alkylsulfonic acids, arylsulfonic acids, and alkylarylsulfonic acids, and more specifically, preferred are dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, naphthalenesulfonic acid, and dinonylnaphthalenesulfonic acid.

The metal to constitute metal sulfonates is preferably sodium, magnesium, calcium, zinc or barium, and above all, from the viewpoint of rust prevention and storage stability, and further from the viewpoint of easy availability, calcium and barium are preferred, and barium is more preferred. Namely, calcium sulfonate and barium sulfonate are preferred, and barium sulfonate is more preferred.

Metal sulfonates are preferably overbased metal sulfonates and neutral metal sulfonates, and from the viewpoint of rust prevention and storage stability, neutral metal sulfonates are preferred. Overbased metal sulfonates and neutral metal sulfonates are, from the viewpoint of rust prevention and storage stability and also from the viewpoint of easy availability, preferably overbased calcium sulfonates, overbased barium sulfonates, neutral calcium sulfonates, and neutral barium sulfonates, more preferably neutral calcium sulfonates and neutral barium sulfonates.

The base number of the overbased metal sulfonate is, from the viewpoint of rust prevention and storage stability and also from the viewpoint of easy availability, preferably 300 mgKOH/g or more, more preferably 400 mgKOH/g or more, even more preferably 500 mgKOH/g or more, and the upper limit thereof is preferably 700 mgKOH/g or less, more preferably 600 mgKOH/g or less, even more preferably 550 mgKOH/g or less. In this description, the base number is a value measured according to the method described in JIS K2501:2003.

The base number of the neutral metal sulfonate is, from the viewpoint of rust prevention and storage stability and also from the viewpoint of easy availability, preferably 200 mgKOH/g or less, more preferably 100 mgKOH/g or less, even more preferably 60 mgKOH/g or less, further more preferably 40 mgKOH/g or less, further more preferably 10 mgKOH/g or less, and the lower limit thereof is preferably 0 mgKOH/g or more, more preferably 0.3 mgKOH/g or more, even more preferably 0.5 mgKOH/g or more.

The metal content in the metal sulfonate is, from the viewpoint of rust prevention and storage stability, preferably 1% by mass or more, more preferably 3% by mass or more, even more preferably 5% by mass or more, and the upper limit thereof is preferably 20% by mass or less, more preferably 18% by mass or less, even more preferably 15% by mass or less.

(Carboxylic Amide)

From the viewpoint of rust prevention and storage stability, carboxylic amides are preferably aliphatic carboxylic amides such as alkenylsuccinic amide, lauric amide, myristic amide, palmitic amide and oleic amide; aliphatic carboxylic monoethanolamides such as lauric monoethanolamide, myristic monoethanolamide, palmitic monoethanolamide, and stearic monoethanolamide; and fatty acid diethanolamides such as lauric diethanolamide, myristic diethanolamide, palmitic diethanolamide, and stearic diethanolamide. Some of these may act as a dispersant and an oily agent, but in the lubricating oil composition of the present embodiment, the essential function of the carboxylic amide is a function as a rust-preventive agent.

The carbon number of the carboxylic amide is, from the viewpoint of rust prevention and storage stability and also from the viewpoint of easy availability, preferably 6 to 36, more preferably 8 to 30, even more preferably 10 to 24.

(Imidazole Compound)

Not specifically limited, the imidazole compound may be any one having an imidazole ring or an imidazoline ring, but is, from the viewpoint of rust prevention and storage stability, preferably imidazoles such as imidazole, methylimidazole, ethylmethylimidazole, benzimidazole, aminobenzimidazole, phenylbenzimidazole, naphthoimidazole, and triphenylimidazole; imidazolines corresponding to the imidazoles; and imidazoline derivatives such as a carboxyimidazoline that has a group containing an oxopyrrolidine-derived carboxyl group in the imidazoline ring. Above all, imidazoline derivatives such as a carboxyimidazoline that has a group containing a carboxyl group in the imidazoline ring are preferred.

(Succinate)

The succinate is, from the viewpoint of rust prevention and storage stability, preferably a half ester of an alkenylsuccinic acid and an alcohol such as a polyalcohol.

The alkenylsuccinic acid is preferably an alkenylsuccinic acid having an alkenyl group having preferably 8 to 28 carbon atoms, more preferably 12 to 20 carbon atoms, even more preferably 16 to 20 carbon atoms.

The polyalcohol for use in forming the succinate is, from the viewpoint of rust prevention and storage stability, preferably those exemplified hereinabove as the diol or the polyol having approximately 3 to 20 hydroxyl groups for forming the above-mentioned polyol esters, and more preferably diols. From the same viewpoint, the carbon number of the polyalcohol is preferably 2 to 12, more preferably 3 to 8, even more preferably 3 to 5. The polyalcohol may be saturated or unsaturated, but is, from the viewpoint of rust prevention and storage stability, preferably saturated.

In the present embodiment, especially preferred examples of the polyalcohol for use in forming succinates include propylene glycol, butylene glycol, trimethylolpropane, glycerin, and pentaerythritol.

(Benzotriazole Compound)

Not specifically limited, the benzotriazole compound for use herein may be any compound having benzotriazole, and preferred examples thereof include, in addition to benzotriazole, alkylbenzotriazoles such as methylbenzotriazole, dimethylbenzotriazole, and ethylbenzotriazole; and aminoalkylbenzotriazoles such as (dihydroxyethylaminomethyl) methylbenzotriazole, (dioctylaminomethyOmethylbenzotriazole, [N-(ethylhexyl)aminomethyl]methylbenzotriazole, and [N,N-bis(ethylhexyl)aminomethyl]methylbenzotriazole. These compounds may have a substituent such as an alkyl group, an amino group and a hydroxy group.

The nitrogen content in the benzotriazole compound is preferably 3 to 50% by mass, more preferably 5 to 45% by mass, even more preferably 10 to 40% by mass.

In the present embodiment, the rust-preventive agent (B) is, in relation with the polyethylene glycol-containing base oil (A), and from the viewpoint of achieving more excellent rust prevention and storage stability, preferably at least one selected from the above-mentioned metal sulfonates, carboxylic amides and succinates, and preferably contains at least a metal sulfonate. Accordingly, the rust-preventive agent (B) may be a metal sulfonate alone, or may be a combination of a metal sulfonate and at least one selected from a carboxylic amide and a succinate, and is, from the viewpoint of rust prevention and storage stability, preferably a combination of a metal sulfonate and at least one selected from a carboxylic amide and a succinate, more preferably a combination of a metal sulfonate and a carboxylic amide.

The content of the rust-preventive agent (B) is, from the viewpoint of rust prevention and storage stability, preferably 0.05% by mass or more based on the total amount of the composition, more preferably 0.1% by mass or more, even more preferably 0.5% by mass or more, further more preferably 1.0% by mass or more, and the upper limit thereof is preferably 3.0% by mass or less, more preferably 2.8% by mass or less, even more preferably 2.5% by mass or less, further more preferably 2.2% by mass or less.

(Antioxidant (C))

The lubricating oil composition for air compressors of the present embodiment preferably contains an antioxidant (C) from the viewpoint of improving oxidation stability and improving storage stability while preventing sludge precipitation due to oxidative deterioration. The antioxidant (C) includes an amine-based antioxidant, a phenol-based antioxidant, a sulfur-based antioxidant and a phosphorus-based antioxidant especially from the viewpoint of oxidation stability and storage stability, and is preferably an amine-based antioxidant among them. One alone or plural kinds of these antioxidants can be used either singly or as combined.

(Amine-Based Antioxidant)

Not specifically limited, the amine-based antioxidant usable herein may be any amine compound having an antioxidation performance, and examples thereof include a naphthylamine and a diphenylamine. One alone or plural kinds of amine-based antioxidants can be used either singly or as combined.

From the viewpoint of oxidation stability and storage stability, combined use of a naphthylamine and a diphenylamine is preferred.

From the viewpoint of oxidation stability and storage stability, examples of the naphthylamine include phenyl-α-naphthylamine, phenyl-ß-naphthylamine, alkylphenyl-α-naphthylamine, and alkylphenyl-ß-naphthylamine, and above all, alkylphenyl-α-naphthylamine and alkylphenyl-ß-naphthylamine are preferred.

The carbon number of the alkyl group that the alkylphenyl α-naphthylamine and the alkylphenyl-ß-naphthylamine have is, from the viewpoint of oxidation stability and storage stability, preferably 1 to 30, and in consideration of the miscibility with the base oil (A), more preferably 1 to 20, even more preferably 4 to 16, further more preferably 6 to 14.

From the viewpoint of oxidation stability and storage stability, the diphenylamine is preferably a compound represented by the following general formula (2), more preferably a compound represented by the following general formula (2').

(2)

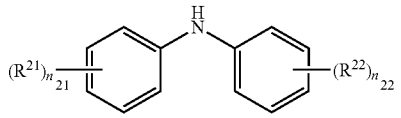

(2')

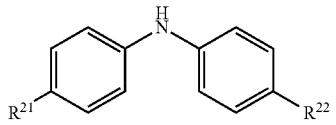

In the general formulae (2) and (2'), $R^{21}$ and $R^{22}$ are each independently an alkyl group having 1 to 30 carbon atoms, or an alkyl group having 1 to 30 carbon atoms substituted with an aryl group having 6 to 18 ring atoms. The alkyl group may be either a linear alkyl group or a branched alkyl group.

In general formula (2), $n_{21}$ and $n_{22}$ are each independently an integer of 0 to 5, preferably 0 or 1, and more preferably 1. Further, when the formulae have plural $R^{21}$'s and $R^{22}$'s, the plural $R^{21}$'s and $R^{22}$'s may be the same as or different from each other.

The carbon number of the alkyl group of $R^{21}$ and $R^{22}$ is 1 to 30, preferably 1 to 20, more preferably 1 to 10.

The aryl group with which the alkyl group may be substituted includes a phenyl group, a naphthyl group and a biphenyl group, and a phenyl group is especially preferred.

The nitrogen content in the diphenylamine is preferably 1% by mass or more, more preferably 2% by mass or more, even more preferably 3% by mass or more, and the upper limit thereof is preferably 15% by mass or less, more preferably 10% by mass or less, even more preferably 8% by mass or less.

In the case where a naphthylamine and a diphenylamine are used as combined, the ratio by mass of the content of the naphthylamine to the diphenylamine is preferably 10/90 to 90/10, more preferably 15/85 to 75/25, even more preferably 25/75 to 60/40, further more preferably 30/70 to 45/55.

(Antioxidant Except Amine-Based Antioxidant)

In the lubricating oil composition for air compressors of the present embodiment, the other antioxidant than the above-mentioned amine-based antioxidant incudes a phenol-based antioxidant, a sulfur-based antioxidant and a phosphorus-based antioxidant.

Examples of the phenol-based antioxidant include monocyclic phenol compounds such as 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl)phenol, 2,6-di-t-amyl-4-methylphenol, and n-octadecyl-3-(3,5'di-t-butyl-4-hydroxyphenyl)propionate; and dicyclic phenol compounds such as 4,4'-methylenebis(2,6di-t-butylphenol), 4,4'-isopropylidenebis(2,6-di-t-butylphenol), 2,2'-methylenebis(4-methyl-6-t-butylphenol), 4,4'-bis(2,6di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

Examples of the sulfur-based antioxidant include 2,6-di-tert-butyl-4-(4,6-bis(octylthio)-1,3,5-triazin-2-ylamino)phenol, a thioterpene compound such as a reaction product of phosphorus pentasulfide and pinene, and a dialkylthio dipropionate such as dilaurylthio dipropionate and distearylthio dipropionate.

The phosphorus-based antioxidant includes diethyl 3,5-di-tert-butyl-4-hydroxybenzylphosphonate.

In the case where the lubricating oil composition of the present embodiment contains an antioxidant (C), the content thereof is, from the viewpoint of improving oxidation stability and also preventing sludge precipitation due to oxidative deterioration to improve storage stability, preferably 2.0% by mass or more based on the total amount of the composition, more preferably 2.5% by mass or more, even more preferably 3.0% by mass or more, further more preferably 4.0% by mass or more, and the upper limit thereof is preferably 10.0% by mass or less, more preferably 9.0% by mass or less, and from the viewpoint of more effectively achieving the use effect of the antioxidant, even more preferably 7.0% by mass or less, further more preferably 6.0% by mass or less.

(Other Additives)

The lubricating oil composition of the present embodiment may be composed of the above-mentioned base oil (A) and rust-preventive agent (B), or may be composed of the above-mentioned base oil (A), rust-preventive agent (B) and antioxidant (C), or may contain any other additive than the above-mentioned rust-preventive agent (B) and antioxidant (C), within a range not detracting from the advantageous effects of the present invention.

Examples of such additives include a viscosity index improver, an antifoaming agent, a friction modifier, and a metal deactivator. One alone or plural kinds of these other additives may be used either singly or as combined.

The content of the other additive is not specifically limited so far as it falls within a range not detracting from the advantageous effects of the present invention, but is generally 0.01% by mass or more and 10.0% by mass or less based on the total amount of the composition, preferably 0.05% by mass or more and 8.0% by mass or less.

(Physical Properties of Lubricating Oil Composition)

The kinematic viscosity at 40° C. of the lubricating oil composition of the present embodiment is preferably 5 to 300 $mm^2/s$, more preferably 10 to 200 $mm^2/s$, even more preferably 15 to 100 $mm^2/s$, further more preferably 25 to 65 $mm^2/s$. The kinematic viscosity at 100° C. of the lubricating oil composition of the present embodiment is preferably 1 to 50 $mm^2/s$, more preferably 3 to 30 $mm^2/s$, even more preferably 5 to 15 $mm^2/s$.

The viscosity index of the lubricating oil composition of the present embodiment is preferably 100 or more, more preferably 115 or more, even more preferably 130 or more, further more preferably 145 or more.

The lubricating oil composition for air compressors of the present embodiment is excellent in oxidation stability and also in rust invention and storage stability, and is especially favorably used for air compressors. The air compressors include centrifugal and axial turbocompressors, pistons, diaphragm-using reciprocating compressors, and screw-type, mobile vane-type, scroll-type and tooth-type rotary compressors.

Further, the lubricating oil composition for air compressors of the present embodiment is also usable as, for example, a turbomachinery lubricating oil (pump oil, turbine oil) for use for lubrication of turbomachinery such as pumps, vacuum pumps, blowers, turbocompressors, nuclear turbines, and gas turbines; a bearing oil and a control system operating fluid for use for lubrication of compressors such as rotary compressors; a hydraulic fluid for use for hydraulic equipments; and a machine tool lubricating oil for use for hydraulic power units of machine tools.

The lubricating oil composition of another embodiment (hereinafter this may be referred to "the other embodiment 1") is a lubricating oil composition for air compressors containing a polyalkylene glycol containing base oil (A) and a rust-preventive agent (B), in which the rust-preventive agent (B) contains at least one metal sulfonate selected from an overbased metal sulfonate and a neutral metal sulfonate. In the other embodiment 1, all the matters described hereinabove relating to the lubricating oil composition of the present embodiment except the rust-preventive agent (B) can be employed as preferred embodiments.

In the other embodiment 1, the rust-preventive agent (B) needs to contain at least one metal sulfonate selected from an overbased metal sulfonate and a neutral metal sulfonate. Using the rust-preventive agent (B) of such a type, excellent oxidation stability and also excellent rust prevention and storage stability can be achieved.

The rust-preventive agent (B) is the same as that described hereinabove in that it preferably contains an overbased metal sulfonate and a neutral metal sulfonate, and the base number of the metal sulfonates is the same as that described hereinabove for the lubricating oil composition of the present embodiment, and the content of the rust-preventive agent (B) is also the same as that described hereinabove for the lubricating oil composition of the present embodiment. The other rust-preventive agents than the sulfonates, as described hereinabove as the rust-preventive agent for the lubricating oil composition of the present invention, are also preferred for the rust-preventive agent to be in the other embodiment 1.

The lubricating oil composition of still another embodiment (hereinafter this may be referred to "the other embodiment 2") is a lubricating oil composition for air compressors containing a polyalkylene glycol-containing base oil (A), a rust-preventive agent (B) and an antioxidant (C), in which the content of the antioxidant (C) is 2.0% by mass or more based on the total amount of the composition. In the other embodiment 2, all the matters described hereinabove relating to the lubricating oil composition of the present embodiment except the antioxidant (C) can be employed as preferred embodiments.

In the other embodiment 2, the lubricating oil composition needs to contain a predetermined amount of the antioxidant (C). Containing a predetermined amount of the antioxidant (C), excellent oxidation stability and also excellent rust prevention and storage stability can be achieved.

In the other embodiment 2, all the matters described hereinabove relating to the kind and the content of the antioxidant (C) for the lubricating oil composition of the present embodiment, except that the content of the antioxidant (C) needs to be 2.0% by mass or more based on the total amount of the composition, can be employed as preferred embodiments.

[Air Compressor Lubricating Method, and Air Compressor]

The air compressor lubricating method of the present embodiment is characterized by using the lubricating oil composition for air compressors of the present embodiment mentioned above. The air compressors to which the lubricating method of the present embodiment is applicable include centrifugal and axial turbocompressors, pistons, diaphragm-using reciprocating compressors, and screw-type, mobile vane-type, scroll-type and tooth-type rotary compressors.

The lubricating oil composition for air compressors of the present embodiment is excellent in oxidation stability and also in rust prevention and storage stability, and therefore, according to the air compressor lubricating method of the present embodiment using the lubricating oil composition for air compressors of the present embodiment, members of air compressors can be prevented from being damaged and excellent operation stability can be achieved.

The air compressor of the present embodiment is characterized by using the lubricating oil composition for air compressors of the present embodiment mentioned above. The air compressor of the present embodiment includes centrifugal and axial turbocompressors, pistons, diaphragm-using reciprocating compressors, and screw-type, mobile vane-type, scroll-type and tooth-type rotary compressors, which use the lubricating oil composition for air compressors of the present embodiment mentioned above.

The lubricating oil composition for air compressors of the present embodiment is excellent in oxidation stability and also in rust prevention and storage stability, and therefore, the air compressor of the present embodiment using the lubricating oil composition for air compressors of the present embodiment can prevent the constituent members thereof from being damaged and can secure excellent operation stability.

EXAMPLES

Next, the present invention is described more specifically with reference to Examples, but the present invention is not limited to these Examples.

(Methods for Measurement of Various Physical Data)

(Kinematic Viscosity, Viscosity Index)

Measured and calculated according to JIS K2283:2000.

(Evaluation Method)

(1) Evaluation of Oxidation Stability (Acid Value after 70 Hours)

Lubricating oil compositions were tested by a modified Indiana oxidation test (IOT) under the test condition and the method mentioned below, and the acid value (mgKOH/g) thereof after 70 hours was measured. Thus tested, those having a smaller acid value can be said to be lubricating oil composition more excellent in oxidation stability. Those having an acid value of 11.0 mgKOH/g or less are judged to be good, and the acid value is preferably 10.0 mgKOH/g or less, more preferably 5.0 mgKOH/g or less, even more preferably 3.0 mgKOH/g or less, further more preferably 1.5 mgKOH/g or less.

(Modified Indiana Oxidation Test)

Via a diffuser stone, fine bubbles of oxygen were infused into a test oil with a spiral Fe/Cu catalyst immersed therein and kept at 150° C., at an oxygen infusion rate mentioned below for 70 hours so as to oxidatively deteriorate the test oil, and after the oxygen infusion, the acid value of the test oil was measured according to the method mentioned below to be an acid value after 70 hours.

Test Temperature: 150° C.

Oxygen Infusion Amount: 3 L/hr

Catalyst: Fe+Cu

Sample Oil Amount: 300 g

Acid Value Measurement: Indicator method according to JIS K2501:2003.

Acid Value Deterioration Time: 70 hours (2) Evaluation of Rust Prevention

According to JIS K2510:1998 (artificial seawater method), rust generation under the condition of 60° C. and 24 hours was confirmed, and evaluated according to the following criteria.

A: No rust was confirmed at all.

B: Rust formed extremely slightly, providing no problem.

C: Rust formed.

(3) Evaluation of Storage Stability 900 mL of the oil composition of Examples and Comparative Examples was put into a 1-L bottle, and left at room temperature (23° C.) for 2 months, and the appearance of the resultant oil composition was evaluated according to the following criteria. Regarding judgement of turbidity, the oil composition having a transmittance of 40% or less in visible light absorptiometry (according to JIS K0115:2004 for absorptiometry at a measurement wavelength of 500 to 550 nm) was judged to have produced turbidity.

A: No turbidity was produced at all.

B: No turbidity was produced until 3 weeks after storage.

C: No turbidity was produced until 1 week after storage.

Examples 1 to 9, Comparative Examples 1 and 2

The base oil (A), the rust-preventive agent (B) and the antioxidant (C) shown below were blended in the blending ratio shown in Table 1, and well mixed to prepare lubricating oil compositions of Examples and Comparative Examples. Details of the components used in preparing these lubricating oil compositions are as follows.

(Base Oil (A))

PAG: Polypropylene glycol represented by $R^{11}$—$(OCH(CH_3)CH_2)_{n11}$—$OR^{13}$ (compound of the general formula (1) where $R^{11}$ and $R^{13}$ are methyl groups, $R^{12}$ is a propylene group, and $n_{12}$ is 1). 40° C. Kinematic viscosity=37.2 $mm^2/s$, viscosity index=173, Mn=800.

POE: Trimethylolpropane triester (complete ester of trimethylolpropane and carboxylic acid having 8 to 10 carbon atoms). 40° C. Kinematic viscosity=19.6 $mm^2/s$, viscosity index=138.

(Rust-Preventive Agent (B))

Metal sulfonate A: Barium dinonylnaphthalenesulfonate (barium content: 6.6% by mass, base number: 0.97 mgKOH/g.

Metal sulfonate B: Barium dinonylnaphthalenesulfonate (barium content: 11.8% by mass, base number: 50.3 mgKOH/g.

Imidazole compound: carboxyimidazoline mixture ("HiTEC536 (product name)", by AFTON Corporation, acid value: 56 mgKOH/g).

Succinate: Half ester of alkenylsuccinic acid and polyalcohol (dodecenylsuccinic acid propylene oxide adduct).

Benzotriazole: 1,2,3-benzotriazole.

(Antioxidant)

Naphthylamine: P-octylphenyl-α-naphthylamine, nitrogen atom content=4.2% by mass.

Diphenylamine A: Bis(p-octylphenyl)amine, compound of the general formula (2') where $R^{21}$ and $R^{22}$ each are an octyl group, nitrogen atom content=3.6% by mass.

Diphenylamine B: Monobutylphenylmonooctylphenylamine, compound of the general formula (2') where $R^{21}$ and $R^{22}$ are butyl group and octyl group, respectively, nitrogen atom content=4.8% by mass.

Diphenylamine C: 4,4-Bis(α,α-dimethylbenzyl)diphenylamine, compound of the general formula (2') where $R^{21}$ and $R^{22}$ are each are a dimethylbenzyl group (methyl group substituted with phenyl group), nitrogen atom content=3.45% by mass.

Thus prepared, the lubricating oil compositions were tested according to the above-mentioned methods to measure the physical data thereof as shown in Table 1, and the properties of the lubricating oil compositions were evaluated. The results are shown in Table 1.

TABLE 1

| | | | | Example | | | | | | | | | Comparative Example | |
|---|---|---|---|---|---|---|---|---|---|---|---|---|---|---|
| | | | | 1 | 2 | 3 | 4 | 5 | 6 | 7 | 8 | 9 | 1 | 2 |
| Composition | (A) | PAG | mass % | 78.00 | 78.70 | 78.80 | 72.80 | 72.80 | 72.20 | 72.20 | 72.20 | 79.00 | 72.75 | 80.00 |
| | | POE | mass % | 20.00 | 20.00 | 20.00 | 20.00 | 20.00 | 23.75 | 23.75 | 23.75 | 20.00 | 24.25 | 20.00 |
| | (B) | Metal Sulfonate A | mass % | 2.00 | 1.00 | 1.00 | 1.00 | 1.00 | 1.00 | 0.00 | 0.00 | 0.00 | 0.00 | 0.00 |
| | | Metal Sulfonate B | mass % | 0.00 | 0.00 | 0.00 | 0.00 | 0.00 | 0.00 | 0.00 | 1.00 | 1.00 | 0.00 | 0.00 |
| | | Imidazole Compound | mass % | 0.00 | 0.30 | 0.20 | 0.20 | 0.00 | 0.00 | 1.00 | 0.00 | 0.00 | 0.00 | 0.00 |
| | | Succinate | mass % | 0.00 | 0.00 | 0.00 | 0.00 | 0.20 | 0.00 | 0.00 | 0.00 | 0.00 | 0.00 | 0.00 |
| | | Benzotriazole | mass % | 0.00 | 0.00 | 0.00 | 0.00 | 0.00 | 0.05 | 0.05 | 0.05 | 0.00 | 0.00 | 0.00 |
| | (C) | Naphthylamine | mass % | 0.00 | 0.00 | 0.00 | 1.50 | 1.50 | 1.00 | 1.00 | 1.00 | 0.00 | 1.00 | 0.00 |
| | | Diphenylamine A | mass % | 0.00 | 0.00 | 0.00 | 1.50 | 1.50 | 1.00 | 1.00 | 1.00 | 0.00 | 1.00 | 0.00 |
| | | Diphenylamine B | mass % | 0.00 | 0.00 | 0.00 | 1.50 | 1.50 | 1.00 | 1.00 | 1.00 | 0.00 | 1.00 | 0.00 |
| | | Diphenylamine C | mass % | 0.00 | 0.00 | 0.00 | 1.50 | 1.50 | 0.00 | 0.00 | 0.00 | 0.00 | 0.00 | 0.00 |
| | | Total | mass % | 100.00 | 100.00 | 100.00 | 100.00 | 100.00 | 100.00 | 100.00 | 100.00 | 100.00 | 100.00 | 100.00 |
| Properties | 40° C. Kinematic Viscosity | | $mm^2/s$ | 40.11 | 39.79 | 39.68 | 45.03 | 45.22 | 42.35 | 42.44 | 42.01 | 39.97 | 42.08 | 39.88 |
| | 100° C. Kinematic Viscosity | | $mm^2/s$ | 8.200 | 8.020 | 8.040 | 8.810 | 8.822 | 8.440 | 8.420 | 8.370 | 8.060 | 8.360 | 8.040 |
| | Viscosity Index | | — | 185 | 182 | 181 | 180 | 180 | 181 | 180 | 180 | 181 | 180 | 180 |
| Evaluation | Oxidation Stability (acid value after 70 hours) | | mgKOH/g | 10.0 | 10.0 | 10.0 | 0.2 | 0.2 | 3.0 | 4.0 | 3.5 | 10.0 | 2.8 | 10.0 |
| | Rust Prevention | | — | A | A | A | A | A | B | B | B | B | C | C |
| | Storage Stability | | — | A | A | A | A | A | A | A | C | C | A | A |

From the results of Examples 1 to 9, it is confirmed that the lubricating oil composition for air compressors of the present embodiment is excellent in oxidation stability and rust prevention. The lubricating oil compositions of Examples 1 to 7 have excellent storage stability, and the lubricating oil compositions of Examples 8 and 9 have good properties with no problem in practical use, though the storage stability thereof is inferior to that of the other Examples. Of Examples 1 to 9, Examples 4 to 8 were tested in a rotary bomb-type oxidation stability test (RBOT) of the following (4), and the RBOT value thereof was 788, 811, 677, 654 and 622 (min), respectively. Also according to this test, the lubricating oil composition of these Examples are confirmed to have excellent oxidation stability.

On the other hand, it is confirmed that the oil lubricating oil compositions of Comparative Examples 1 and 2 are excellent in storage stability but the rust prevention thereof is extremely poor.

(4) Evaluation of Oxidation Stability (Rotary Bomb-Type Oxidation Stability Test: RBOT)

According to the rotary bomb-type oxidation stability test (RBOT) of JIS K 2514-3, the lubricating oil compositions were tested at a test temperature of 150° C. and under an initial pressure of 620 kPa, and the time (RBOT value) taken until the pressure decreased from the highest pressure down to 175 kPa was measured. The lubricating oil compositions having a longer time can be said to be more excellent in oxidation stability.

Examples 10 to 12, Comparative Examples 3 and 4

The base oil (A), the rust-preventive agent (B) and the antioxidant (C) were blended in the blending ratio shown in Table 2, and well mixed to prepare lubricating oil compositions of Examples and Comparative Examples. Details of the components used in preparing these lubricating oil compositions are as mentioned above.

TABLE 2

| | | | | Example | | | | | Comparative Example | | | |
|---|---|---|---|---|---|---|---|---|---|---|---|---|
| | | | | 4 | 9 | 10 | 11 | 12 | 1 | 2 | 3 | 4 |
| Composition | (A) | PAG | mass % | 72.80 | 79.00 | 70.80 | 73.00 | 71.00 | 72.75 | 80.00 | 76.00 | 72.00 |
| | | POE | mass % | 20.00 | 20.00 | 20.00 | 20.00 | 20.00 | 24.25 | 20.00 | 20.00 | 20.00 |
| | (B) | Metal Sulfonate A | mass % | 1.00 | 0.00 | 1.00 | 0.00 | 0.00 | 0.00 | 0.00 | 0.00 | 0.00 |
| | | Metal Sulfonate B | mass % | 0.00 | 1.00 | 0.00 | 1.00 | 1.00 | 0.00 | 0.00 | 0.00 | 0.00 |
| | | Imidazole Compound | mass % | 0.20 | 0.00 | 0.20 | 0.00 | 0.00 | 0.00 | 0.00 | 0.00 | 0.00 |
| | | Succinate | mass % | 0.00 | 0.00 | 0.00 | 0.00 | 0.00 | 0.00 | 0.00 | 0.00 | 0.00 |
| | | Benzotriazole | mass % | 0.00 | 0.00 | 0.00 | 0.00 | 0.00 | 0.00 | 0.00 | 0.00 | 0.00 |
| | (C) | Naphthylamine | mass % | 1.50 | 0.00 | 2.00 | 1.50 | 2.00 | 1.00 | 0.00 | 1.00 | 2.00 |
| | | Diphenylamine A | mass % | 1.50 | 0.00 | 2.00 | 1.50 | 2.00 | 1.00 | 0.00 | 1.00 | 2.00 |
| | | Diphenylamine B | mass % | 1.50 | 0.00 | 2.00 | 1.50 | 2.00 | 1.00 | 0.00 | 1.00 | 2.00 |
| | | Diphenylamine C | mass % | 1.50 | 0.00 | 2.00 | 1.50 | 2.00 | 0.00 | 0.00 | 1.00 | 2.00 |
| | | Total | mass % | 100.00 | 100.00 | 100.00 | 100.00 | 100.00 | 100.00 | 100.00 | 100.00 | 100.00 |

TABLE 2-continued

| | | | Example | | | | | Comparative Example | | | |
|---|---|---|---|---|---|---|---|---|---|---|---|
| | | | 4 | 9 | 10 | 11 | 12 | 1 | 2 | 3 | 4 |
| Properties | 40° C. Kinematic Viscosity | $mm^2/s$ | 45.03 | 39.97 | 46.88 | 44.98 | 47.10 | 42.08 | 39.88 | 42.32 | 47.43 |
| | 100° C. Kinematic Viscosity | $mm^2/s$ | 8.810 | 8.060 | 9.100 | 8.770 | 9.150 | 8.360 | 8.040 | 8.440 | 9.180 |
| | Viscosity Index | — | 180 | 181 | 182 | 180 | 180 | 180 | 180 | 180 | 180 |
| Evaluation | Oxidation Stability (acid value after 70 hours) | mgKOH/g | 0.2 | 10.0 | 0.2 | 1.2 | 0.7 | 2.8 | 10.0 | 2.0 | 0.3 |
| | Rust Prevention | — | A | B | A | A | A | C | C | C | C |
| | Storage Stability | — | A | C | A | B | B | A | A | A | A |

From the results of Examples 10 to 12, it is confirmed that the lubricating oil composition for air compressors of the present embodiment is excellent in oxidation stability, rust prevention and storage stability. In comparing Examples 4 and 10 with Examples 11 and 12, it is known that, in the case where a metal sulfonate is used as the rust-preventive agent (B), the metal sulfonate A having a low base number (neutral metal sulfonate) tends to improve storage Stability. Examples 10 to 12 were tested in the rotary bomb type oxidation stability test (RBOT) of the above (4), and were confirmed to have a RBOT value of 989, 822 and 923 (min), respectively, and according to the test, the lubricating oil compositions of these Examples were confirmed to have excellent oxidation stability.

In comparing Example 9 with Examples 4, 11 and 12, it is known that the lubricating oil containing the antioxidant (C) tends to have improved oxidation stability and storage stability. On the other hand, in comparing Comparative Examples 1 and 2 with Comparative Examples 3 and 4, it is known that rust prevention and storage stability do not tend to improve in the absence of the rust-preventive agent (B) even though the amount of the antioxidant (C) added is increased.

The invention claimed is:

1. A lubricating oil composition suitable for an air compressor, the composition comprising, based on total composition mass:

a polyalkylene glycol base oil (A1) in 71.0% by mass or more;

a polyol ester base oil (A2) in a range of from 15.0 to less than 25% by mass;

a rust-preventive agent (B) in a range of from 1.0 to 3.0% by mass; and an antioxidant (C) in a range of from 1.0 to 8.0% by mass, wherein the rust-preventive agent (B) is a barium sulfonate having a base number of 40 mgKOH/g or less, and optionally further a carboxylic amide, imidazole compound, succinate, benzotriazole compound, or a mixture of two or more of any of these, wherein the antioxidant (C) is a naphthylamine, a diphenylamine, or a mixture of two or more of any of these, and wherein the composition has a viscosity index of at least 145.

2. The composition of claim 1, wherein the rust-preventive agent (B) is present in a range of from 1.0 to 2.8% by mass, based on the total composition mass.

3. The composition of claim 1, wherein the rust-preventive agent (B) comprises no benzotriazole compound.

4. The composition of claim 1, comprising a neutral barium sulfonate.

5. The composition of claim 4, wherein the barium sulfonate has a base number of 0.97 mgKOH/g or less.

6. The composition of claim 1, wherein the antioxidant (C) is present in a range of from 1.5 to 6.0% by mass, based on the total composition mass.

7. The composition of claim 6, wherein the antioxidant (C) is present in a range of from 3.0 to 6.0% by mass, based on the total composition mass.

8. The composition of claim 1, comprising no mineral oil.

9. An air compressor lubricating method, comprising:

lubricating an air compressor with the lubricating oil composition of claim 1.

10. An air compressor, comprising the lubricating oil composition of claim 1.

11. The composition of claim 1, wherein the polyol ester base oil (A2) is in a range of from 20.0 to less than 25.0% by mass, based on the total composition mass.

12. The composition of claim 1, wherein the polyalicylene glycol base oil (A1) has a number-average molecular weight, Mn, in a range of from 200 to 1,500.

13. The composition of claim 1, wherein the polyalkylene glycol base oil (A1) has a number-average molecular weight, Mn, in a range of from 200 to 800.

14. The composition of claim 1, wherein the antioxidant (C) comprises phenyl-α-naphthylamine, phenyl-βnaphthylamine, alkyphenyl-α-naphthylamine, alkylphenyl-β-naphthylamine, or a mixture of two or more of any of these.

15. The composition of claim 1, wherein the antioxidant (C) comprises a diphenylamine of formula (2):

(2)

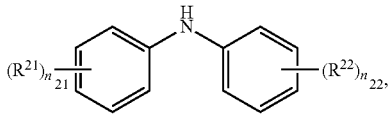

wherein $R^{21}$ and $R^{22}$ are independently an alkyl group having 1 to 30 carbon atoms, or an alkyl group having 1 to 30 carbon atoms substituted with an aryl group having 6 to 18 ring atoms, and $n_{21}$ and $n_{22}$ are independently 0 or 1.

16. The composition of claim 1, wherein the rust-preventive agent (B) further comprises at least one selected from group consisting of the imidazole compound and. the succinate, and wherein the rust-preventive agent (B) is present in a range of from 1.20 to 2% by mass.

17. The composition of claim 1, comprising the antioxidant (C), wherein the rust-preventive agent (B) comprises the neutral barium sulfonate, but no benzotriazole compound.

18. The composition of claim 1, comprising the antioxidant (C), wherein the barium sulfonate in the rust-preventive agent (B) comprises a barium dinonylnaphthalenesulfonate, but the rust-preventive agent (B) comprises no benzotriazole compound.

19. A lubricating oil composition, consisting essentially of, based on total composition mass:

a polyalkylene glycol base oil (A1) in a range of from 70.0 to 79.0% by mass;

a polyol ester base oil (A2) in 20.0% by mass or more;

a rust-preventive agent (B) in a range of from 1.0 to 3.0% by mass; and an antioxidant (C) in a range of from 1.0 to 8.0% by mass, wherein the rust-preventive agent (B) is a neutral or low overbased barium sulfonate and optionally further at least one selected from group consisting of a metal sulfonate, imidazole compound, and succinate, wherein the antioxidant (C) is selected from the group consisting of a naphthylamine, a diphenylamine, and a mixture of two or more of any of these, and wherein the composition has a viscosity index of at least 145.

* * * * *